United States Patent [19]

Renn et al.

[11] Patent Number: 4,630,874

[45] Date of Patent: Dec. 23, 1986

[54] ZERO INSERTION FORCE ELECTRICAL INTERCONNECTION ASSEMBLY

[75] Inventors: Robert M. Renn, Pfafftown; John R. Shoemaker, Reidsville, both of N.C.

[73] Assignee: AMP Incorporated, Harrisburg, Pa.

[21] Appl. No.: 747,088

[22] Filed: Jun. 20, 1985

[51] Int. Cl.[4] ..... H01R 9/07

[52] U.S. Cl. ..... 339/17 F; 339/75 MP

[58] Field of Search ..... 339/17 F, 17 CF, 75 MP, 339/75 M, 176 MF

[56] References Cited

U.S. PATENT DOCUMENTS

| | | | |
|---|---|---|---|
| 4,169,641 | 10/1979 | Olsson | 339/17 F |
| 4,172,626 | 10/1979 | Olsson | 339/17 F |
| 4,181,386 | 1/1980 | Olsson | 359/17 F |
| 4,235,500 | 11/1980 | Belopavlovich et al. | 339/176 MF |
| 4,252,389 | 2/1981 | Olsson | 339/17 F |
| 4,252,393 | 2/1981 | Johnson | 339/17 F |
| 4,379,608 | 4/1983 | Olsson et al. | 339/17 F |
| 4,460,223 | 7/1984 | Brown et al. | 339/17 CF |

FOREIGN PATENT DOCUMENTS

| | | | |
|---|---|---|---|
| 1039037 | 8/1983 | U.S.S.R. | 339/176 MF |

*Primary Examiner*—Neil Abrams

*Attorney, Agent, or Firm*—Katherine A. Nelson

[57] ABSTRACT

An electrical interconnection assembly intended for interconnecting an array of conductors in a cable to conductors on a substrate is disclosed. The assembly is comprised of a spring metal member and a housing member, said spring member having means for being pivotally mounted to said housing. Said housing means has a plurality of conductor members therein, each engageable to corresponding circuitry on the substrate. Said spring member has a stamped and formed body with a first and second section joined by an intermediate bight. The first and second sections are mutually relatively deflectable about the bight to a second position. The assembly further has a locking means to retain said body in its second position in said housing. Energy is stored in the body in its second position whereby upon positioning the cable conductors between the second body section and the circuitry of the housing member and deflecting the first section to the second position and engaging said lock, the stored energy is transmitted through the second section to the conductor array to maintain a normal force electrical contact between the cable conductors and the circuitry on the substrate.

27 Claims, 10 Drawing Figures

ZERO INSERTION FORCE ELECTRICAL INTERCONNECTION ASSEMBLY

FIELD OF THE INVENTION

This invention relates to electrical interconnection devices of the type intended for connecting cable conductors to conductors on a circuit board and in particular to those devices requiring zero insertion force.

BACKGROUND OF THE INVENTION

When the conductors in a flat conductor cable must be disengageably connected to conductors on a circuit board, it is common practice to use electrical connectors of a type comprising an insulating housing having contact terminals therein which are soldered to the conductors on the circuit board. The housing and the contact terminals are arranged such that the end of the flat conductor cable can be inserted into the housing and upon insertion, the conductors of the cable will be electrically contacted by the contact terminals. Other types of connectors for connecting flat conductor cable conductors to conductors on a circuit board are also known and most of them consist of an insulating housing containing contact terminals which conduct current from the cable conductors to the circuit board conductors.

It is also known to use devices such as connector clip to connect conductors of a flat conductor cable to conductors on a circuit board. Devices of this type are disclosed in U.S. Pat. Nos. 4,169,641; 4,172,626; 4,181,386; and 4,252,389.

U.S. Pat. No. 4,169,641 discloses a connector clip device for connecting the conductors of a flat conductor cable to conductors on a circuit board comprised of a single one-piece stamped and formed device which holds the cable conductors directly against the circuit board conductors. The connector is a flat clip member having parallel spaced-apart coplanar support strips and a clip bar which extends between the support strips in a plane which is offset from the plane of the support strips. A plurality of cantilever springs extend from the clip bar obliquely towards and past the plane of the support strips. The connector clip is mounted on the circuit board in a straddling relationship to the circuit board conductors with the cantilever springs in alignment with the circuit board conductors. The end of the flat conductor cable is inserted beneath the clip bar and pushed parallel to the springs and the support strips until the cable is beneath the free ends of the springs and the cable conductors are against the circuit board conductors. The springs bear against the insulated top surface of the cable so that the circuit board conductors and the cable conductors are pressed against each other to establish electrical contact. The clip does not carry an electrical current but merely clamps the conductors together.

U.S. Pat. No. 4,172,626 discloses and claims a one-piece stamped and formed connector clip which is adapted to be mounted on a circuit board in straddling relationship to a plurality of parallel side-by-side conductors on the circuit board. The clip serves to connect conductors on a thin film to the circuit board. The clip has a plurality of cantilever springs extending from one of its edges which bear resiliently against the circuit board conductors when the clip is mounted on the circuit board. The clip does not carry an electrical current but merely clamps the film conductors against the circuit board conductors. The conductors on the film are disengageably connected to the circuit board conductors by simply inserting a portion of the film between the spring members of the clip and the surface of the board so that the springs serve to clamp the film conductors against the circuit board conductors. Connector clips also can be used to connect cable conductors to terminal posts extending from a board or to flat conductors on the surface of the circuit board.

Connector clips of the types disclosed in the two patents discussed above can be used successfully and to advantage when the film is comparatively strong and firm and the conductors are durable and resistant to damage from abrasion. Thus, clips as described in the above patents can be used for example where the film is relatively heavy such as a polyester film and the conductors are of wrought copper conductors bonded to the film.

Difficulties are encountered when it is attempted to use such a connector clip with extremely thin films having fragile conductors on their surface. The thin films tend to buckle when an attempt is made to insert them between the springs of the connector slip and the surface of the circuit board against which the springs are biased. The fragile conductors such as printed conductors and screened conductors, which are widely used on extremely thin films are, furthermore, damaged during insertion of the film for the reason that they cannot withstand the abrasive effects of the springs as they are inserted between the connector clip and the surface of the circuit board.

U.S. Pat. Nos. 4,181,386 and 4,252,389 disclose connector clips having zero insertion force characteristics, that is an arrangement whereby the film can be inserted when the contact springs are spaced from the conductors on the surface of the circuit board so that no compressive forces are imposed on the film or on the conductors during insertion.

The connector clip disclosed and claimed in U.S. Pat. No. 4,181,386 is comprised of a rectangular clip bar having spaced-apart cantilever springs extending from one of its side edges. These springs are reversely bent adjacent to the one side edge and extend from the bent portions diagonally towards the conductors on the surface of the circuit board. Each spring is resiliently biased against a conductor when the clip is mounted on the circuit board so that a cable or film can be inserted between the springs and the surface of the circuit board and the springs will press the film conductors against the circuit board conductors. The zero insertion force feature is achieved by providing the free ends of the spring members with tool-engageable portions and constructing the clip for cooperation with a tool which is uniquely suited to engage the free ends of the springs and raise them from the surface of the circuit board during insertion of the film.

The device disclosed and claimed in U.S. Pat. No. 4,252,389 is of the general class described in U.S. Pat. No. 4,181,386. The zero insertion force feature is achieved, however, by providing an integral unloading means for the springs that does not require the use of a specialized tool. The clip is comprised of a one-piece stamped and formed member having a clip bar and having cantilever springs extending from one side edge of the clip bar. The springs are reversely bent and have spring arm portions which extend towards, and are resiliently biased against, the circuit board conductors when the clip is mounted on the circuit board, the contact areas being beneath the clip bar. Each spring has an end portion which extends from the contact area diagonally away from the surface of the circuit board and beyond the other side edge of the clip bar. A lifting bar is provided at the ends of the springs so that the springs can be raised from the surface of the circuit board by merely moving the lifting bar away from the surface of the circuit board.

SUMMARY OF THE INVENTION

The present invention is directed to a zero insertion interconnection assembly for connecting cable conductors to conductors on a circuit board and in particular to an assembly for interconnecting conductors in cables that approach the board in a direction essentially vertical to the board. A device for interconnecting conductors in cables that approach the board in a direction essentially horizontal to the board is disclosed in U.S. patent application Ser. No. 747,092 entitled Electrical Interconnection Device and filed concurrently herewith.

An electrical interconnection assembly is comprised of a housing attachable to the substrate and having a plurality of upstanding conductor members each attachable to corresponding circuitry on the substrate; a unitary spring metal member attachable to the housing and locking means. The spring metal member is comprised of a formed metal body having a first section and a second section joined by an intermediate bight. The first and second sections are relatively inclined about an acute included angel in a first position and are mutually relatively deflectable about the bight to a second position in which the relative inclination therebetween is less than that in the first position. The locking means is comprised of a locking extension depending from the first body section and an extension receiving notch in the housing for retaining the first and second section sin the second position. Energy is stored in the body in the second position, whereby upon positioning the array of conductors between the second body section and the conductor members in the housing, and deflecting the first section to the second position, the stored energy is transmitted through the second section to the conductor array to maintain a normal force electrical contact between the conductors in the array and the circuitry on the substrate.

BRIEF DESCRIPTION OF THE DRAWINGS

FIG. 3 is a view similar to FIG. 2 showing the cable in the assembly and the assembly in its closed position;

FIG. 5 is a cross-sectional view of the assembly in its closed position;

DESCRIPTION OF THE PREFERRED EMBODIMENT

Figure 1:
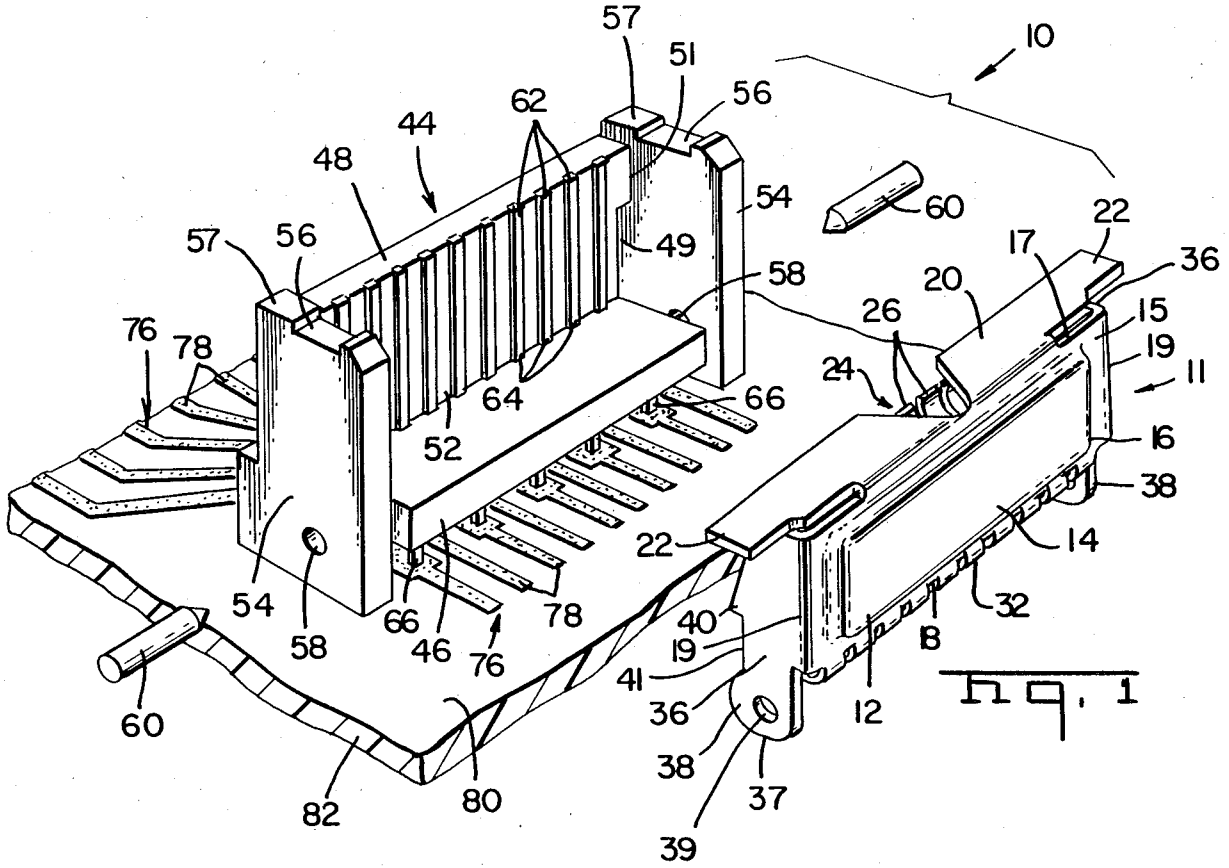
FIG. 1 is a perspective view of the electrical interconnection assembly mounted on a substrate with the spring metal member exploded from the housing member.

FIGS. 1 through 5 show an electrical interconnecting assembly 10 comprised of a unitary spring metal member 11 and a dielectric housing means 44. The interconnecting assembly 10 in accordance with the invention serves to connect the spaced apart conductors 70 in a cable 72 to an array of spaced apart upstanding conducting members 62 which are interconnected to corresponding circuitry 76 on surface 80 of substrate 82.

The unitary spring metal member 11 has a body 12 comprised of a first or outer section 14, a second or inner section 24, and an intermediate bight section 32 which connects the first and second sections 14 and 24.

The first section 14 is comprised of a rectangular plate member 15 having first and second essentially parallel side edges 17, 18 and end edges 19. The plate member 15 may be embossed as shown at 16 to improve its stiffness along its entire length between the end edges 19. The first side edge 17 has an outwardly directed flange 20 extending therefrom. The flange 20 has locking extensions 22 which extend beyond the end edges 19 of the plate member 15. The plate member 15 further has end sections 36 extending along ends 19, said end sections 36 lying essentially parallel to each other and essentially perpendicular to said first and second body sections 14, 24. End sections 36 have a projection 40 extending outwardly from the edge 41 of the end section that is opposite the edge attached to said plate member 15, said projection being part of the strain relief means 43. The end sections 36 further have securing means 38 along the lower edge 37 of said end section to secure said spring member 11 to the housing means 44. In the embodiment illustrated in FIGS. 1-5, said securing means is a bore 39 which cooperates with securing means on said housing 44.

The second body section is comprised of at least one and preferably a plurality of cantilevered spring arms 26, said spring arms 26 being reversely bent through the bight section 32 and joined to second edge 18 of the plate member 15.

Figure 4:
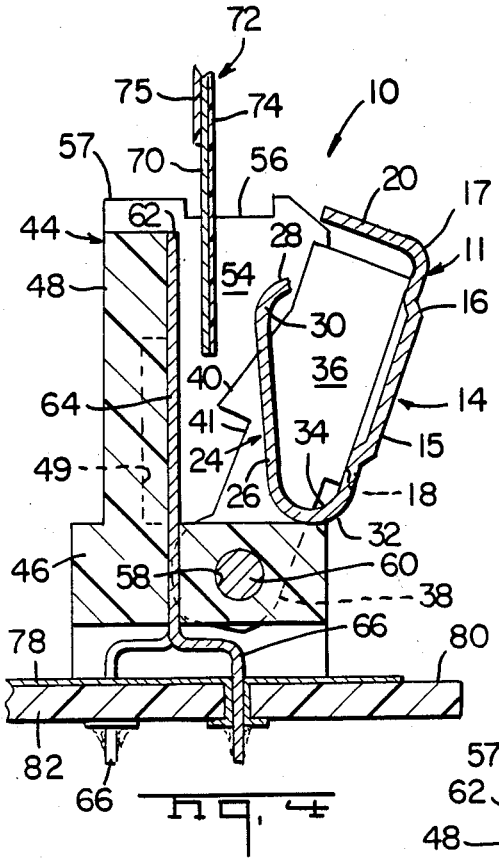
FIG. 4 is a cross sectional view of the assembly in its open position.

The spring arms 26 are reversely formed at their free ends 28 as shown in FIGS. 4 and 5 to define a pressure applying arcuate portion 30 on each spring arm 26. As is best seen in FIGS. 4 and 5, the reverse bend in the bight section 32 is such that the cantilevered spring arms are behind the first body section. The first and second sections 14 and 24 are relatively inclined about an acute included angle 34 in the intermediate bight section 32 and are mutually relatively deflectable about the bight section 32. The relative size of this angle changes as the assembly is moved from its open to its closed position as is seen in FIGS. 4 and 5.

The housing means 44 is preferably a one piece dielectric member comprised of a base 46 and support wall 48 which extends perpendicular to the base of the housing 44. The housing 44 has attaching means for attaching it to the substrate 82. When the housing 44 is attached to the substrate 82 the base 46 lies essentially parallel to the substrate 82. The support wall 48 further has at least one strain relief notch 49 proximate the perpendicular edges 51 of the support wall 48, said notches 49 cooperating with said strain relief projection 41 on said spring member 11. The strain relief means is best illustrated in FIGS. 4 and 5. A plurality of upstanding conductor members 62 lie against surface 52 of support wall 48. The conductor members are comprised of a first section 64 which extends along said support wall 48 and a second section 66 which has interconnection means to provide electrical contact with the conductors 78 on substrate 82.

The housing is further comprised of two oppositely facing sidewalls 54, one edge of each sidewall 54 being attached to the support wall 48 and a second edge of each sidewall 54 being attached to the base 46. The sidewalls 54 extend perpendicular to the substrate 82. The sidewalls 54 have a locking notch 56 along their top edge 57. This locking notch 56 cooperates with the locking extensions 22 of the spring member when the assembly 10 is in its second or closed position. The sidewalls 54 further have a bore 58 which extends through the sidewall 54 and is dimensioned to receive hinge pins 60 which are inserted through the bore 58 and into the corresponding bore 39 of the spring member 11. When the housing 44 and spring member 11 are assembled, the hinge pins 60 provide a pivoting point for the members of the assembly 10. This can best be illustrated by referring to FIGS. 4 and 5.

The cable 72 is generally of the type having a plurality of flat conductors 70 which are encased within or deposited on a film 74 of insulating material such as a polyester or polyimide film. The conductors may be formed from discrete metal wires, a metal sheet which has been etched to form traces or traces deposited by screening as known in the art. The conductors 70 need to be exposed on the portion of the undersurface of the cable 72 that will be inserted into the device 10. A cable 72 having conductors 70 encased within two layers 74, 75 of dielectric film is used for purposes of illustration as is best shown in FIGS. 4 and 5. A portion of the under layer 75 has been removed to expose the conductors 70.

Figure 2:
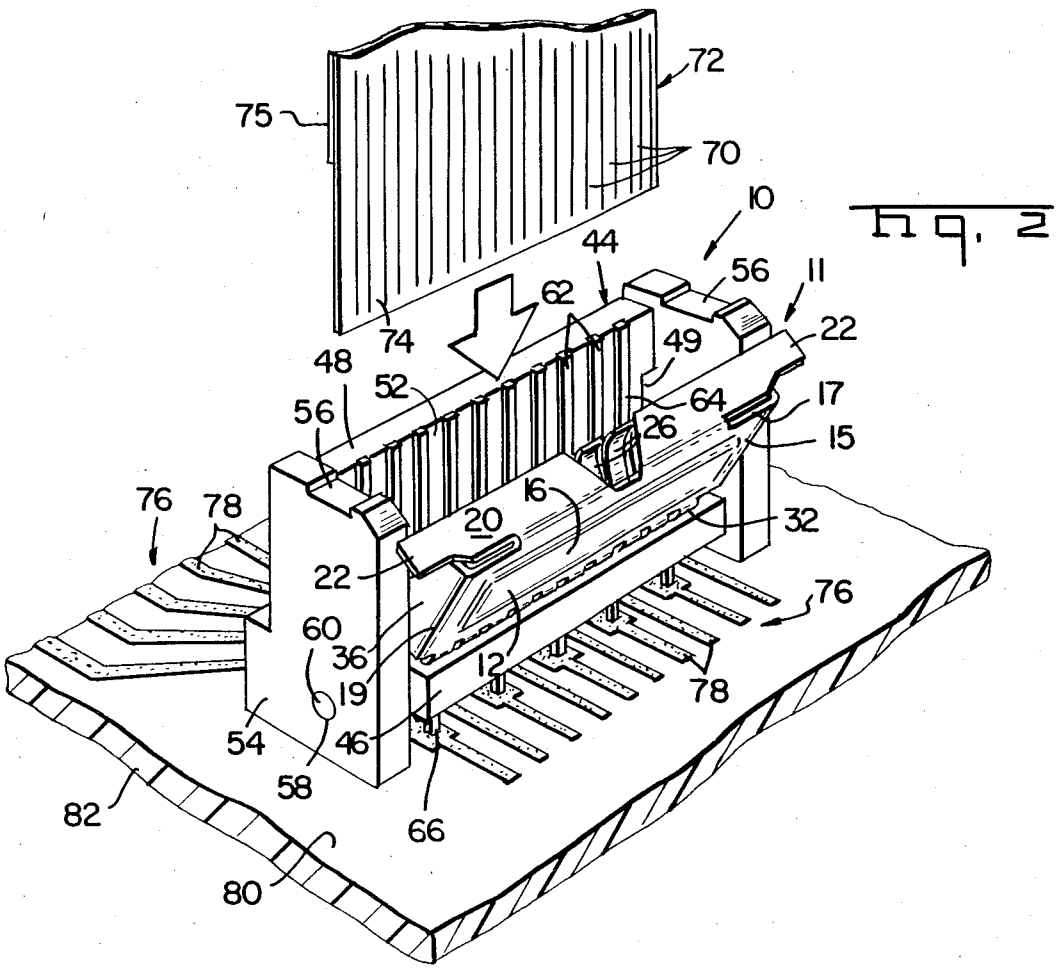
FIG. 2 is a view similar to FIG. 1 with the spring member mounted to the housing, and illustrating insertion of a cable into the open assembly.
Figure 1:
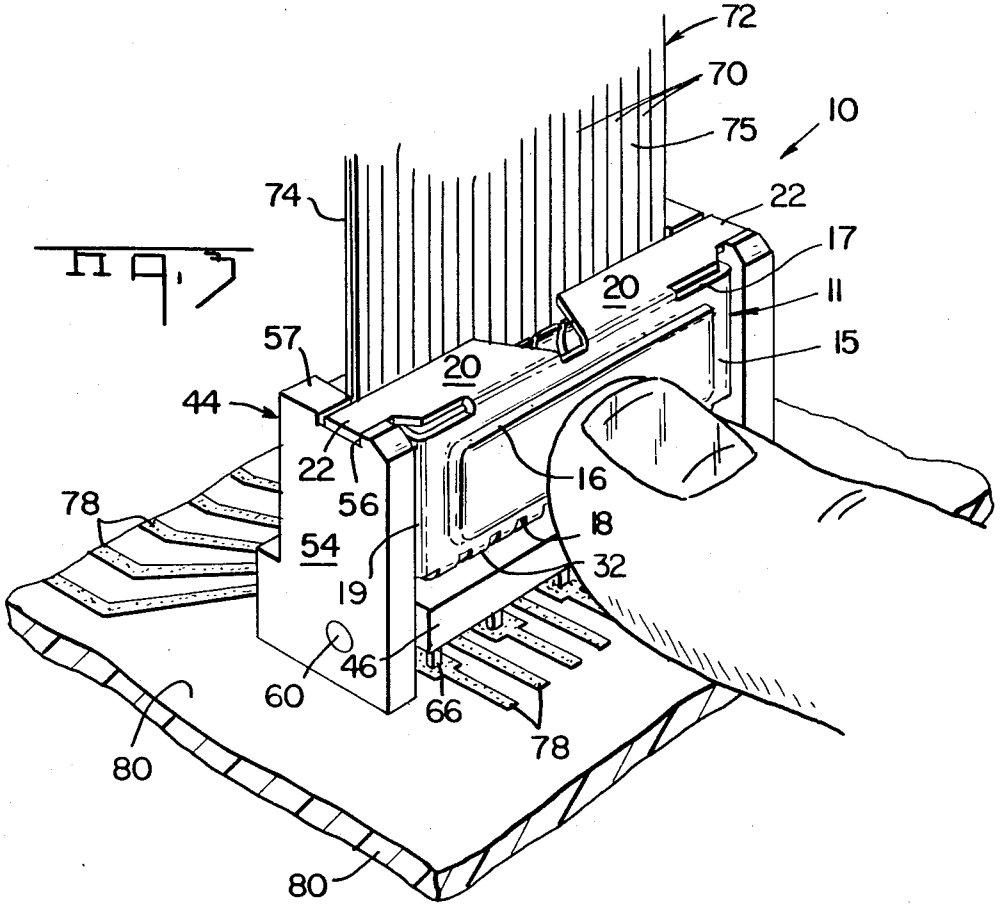

FIG. 2 illustrates the insertion of a cable 72 into the interconnecting assembly 10. Cable 72 is comprised of a plurality of spaced apart conductors 70 having a first layer 74 of insulation on one side and an exposed portion of conductors on the second side. When the cable 72 is inserted the exposed conductors are brought into a spaced apart relationship with corresponding upstanding conductor members 62 on the surface 52 of the housing 44. The assembly 10 is closed by pushing against the first body section 14 until latching means 22 is engaged by the latching notch 56 in the support wall 54. The operation of the invention is best illustrated in FIGS. 4 and 5. When spring member 11 is in its open position the cable 70 may be inserted under zero insertion force conditions. The spring arm 26 is sufficiently spaced from the upstanding conductor member 62 that the cable 72 may move freely into the space therebetween. When the spring member 11 is in its closed position the pressure applying portions 30 of the spring arms 26 lie against the insulating layer 74 covering one or more of the conductors 70 of the cable 70 thus effecting interconnection between the cable conductors 72 and the corresponding upstanding conductors 62. FIGS. 4 and 5 also illustrate strain relief mechanism. The strain relief notches 49 in the support wall 48 are adjacent the sidewalls 54. As the spring member 11 is brought into its closed or second position strain relief extension 41 forces a portion of the cable 72 into the strain relief notches 49 thus providing increased tension to retain cable 72 in the assembly 10.

In using the assembly, the interconnecting assembly 10 is mounted onto the surface 80 of the substrate 82 by attaching the housing means 44 to the substrate 82. In the preferred embodiment the upstanding conductor members 62 are a plurality of terminal posts, the first portion of which extend through the base 46 and lie along the support member 48. The second section of the terminal posts are inserted into the substrate 82 and are soldered to corresponding conductors 78. It is to be understood that the upstanding conductor members may be conductive ink traces, etched circuitry and other essentially flat elongated conductor members. It is also to be understood that other mounting means and interconnecting means between the support wall and base may be used such as adhesive, or surface mounting means.

The spring member 11 is attached to the housing 44 by means of the pivot and hinge pins 60. The spring member 11 is mounted to the housing 44 so that the cantilevered spring members 26 will lie juxtaposed to the upstanding conductor members 62 on the surface 52 of the support wall 48. The assembly 10 is dimensioned so that the housing sidewalls 54 are positioned on the substrate outside the area of the circuitry. In the embodiment illustrated best in FIGS. 4 and 5 the second portion 66 of the terminal posts 62 are bent as they exit the housing 44 so that the ends enter the circuit board conductors 78 in a staggered configuration. Depending upon the spacing between the conductors 78 the second portions 66 may be attached in a staggered or inline configuration.

FIGS. 2 and 4 illustrate the assembly 10 in its open position. In FIG. 4 the cable 72 is being inserted between the support wall conductors 62 and the spring member 11. As is illustrated in FIG. 4 the exposed conductors 70 of the cable 72 lie against the upstanding conductor members 62.

FIGS. 3 and 5 illustrate the assembly in its closed position. As pressure is applied to the first section 14, the first section is deflected, the flange moves inwardly and locking extensions 22 move into the notches 56 on the sidewalls 54 of the housing 44 to hold the first section 14 of the spring member 11 in the locked position. As the assembly is locked, pressure is asserted by the spring arms 26 against the insulation 74 and conductors 70 bringing the cable conductors 70 into electrical contact with the upstanding conductor members 62. In its closed position, the relative inclination between the first and second sections 14, 24 is less than the relative inclination between the first and second sections 14, 24 in its open or first position. Energy is stored in the body when the assembly 10 is in its second position. This stored energy is transmitted through the second section 24 to the conductor array to maintain a normal force electrical contact between the cable conductors 70 and the array of upstanding conductor members 62.

Figure 9:
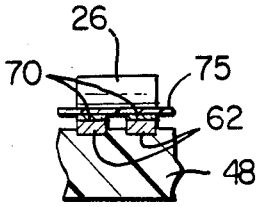
FIG. 9 is a fragmentary sectional view of the end of the spring arm exerting force on two conductors.
Figure 10:
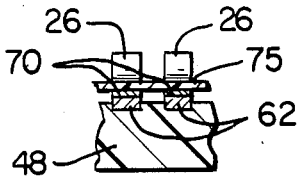
FIG. 10 is a view similar to FIG. 9, illustrating the end of the spring arm exerting force on one conductor.

As shown in FIGS. 9 and 10 the end 28 of the cantilevered spring arm section 26 may be shaped to apply pressure to one or more conductors 70 at the same time. Since pressure is applied through the insulation layer, no electrical interconnection occurs between the adjacent conductors. Depending upon the spacing of the cable conductors 70 and the upstanding conductors 62 the end section 30 of the cantilevered arms may be expanded to cover a broader area than the basic width of one conductor. It is preferable, however, that there be a plurality of spring arm members 26 to allow for variations in thickness of conductors 62 along the support wall or in a cable 72. The cantilever springs 26, however, are independent of each other at their ends and the performance of the connector will not therefore be affected by non-uniform thicknesses in the conductors. In other words, if one of the conductors is significantly thicker than the remaining conductors, this "high" connector will not hold the remaining contact springs elevated from the relatively low conductors a single cantilevered spring member may be used where the thickness of the conductors is essentially the same. The dimensions of the device 10 should be related to the dimensions of the cable 72 and the dimensions of the circuitry 76 on the substrate 82. It is not necessary, however, that each individual cantilevered spring arm 26 be dimensioned precisely to the size of the conductor, thus allowing the device to be used on circuitry having a high density of conductors. Since there is no electricity conducted through the interconnection device 10, the individual spring arms may be wider than an individual conductor and in fact span more than one of them.

Figure 7:
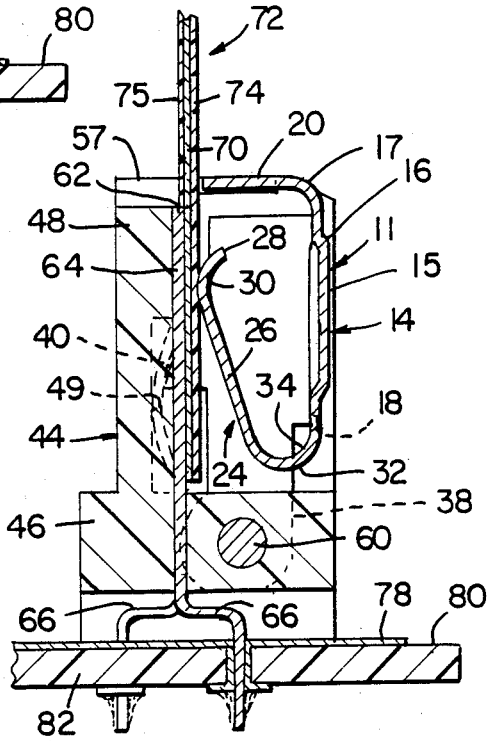
FIG. 7 is a cross-sectional view taken along line 7—7 of view 6.
Figure 6:
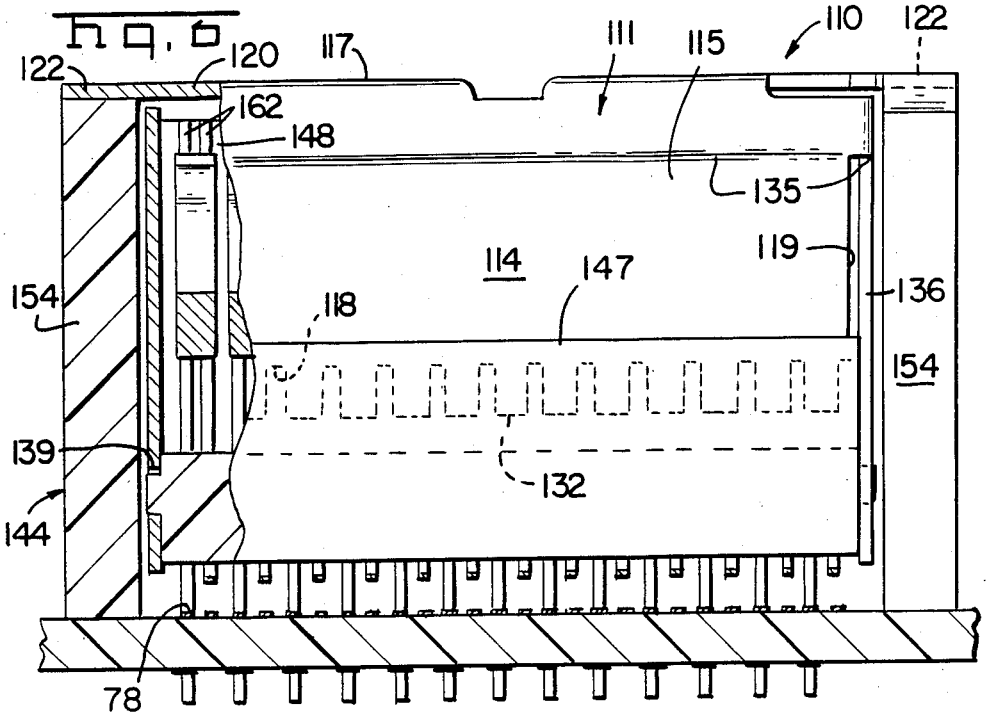
FIG. 6 is a front elevational view of an alternative embodiment of the assembly with parts broken away as viewed along the line 6—6 of FIG. 7.
Figure 7:
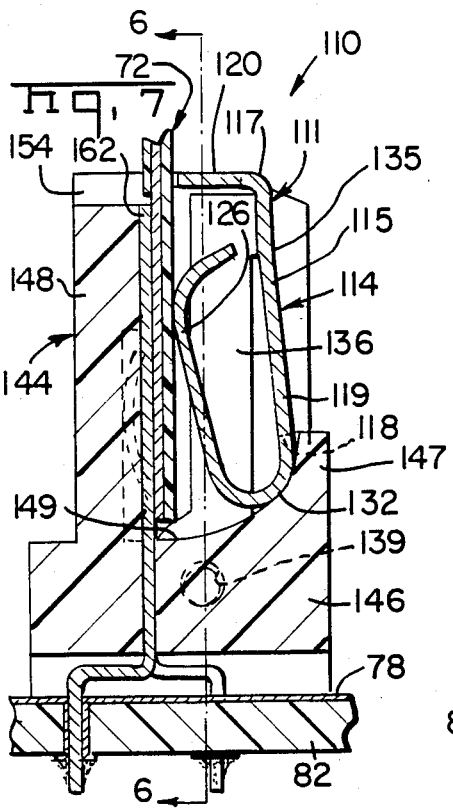
Figure 8:
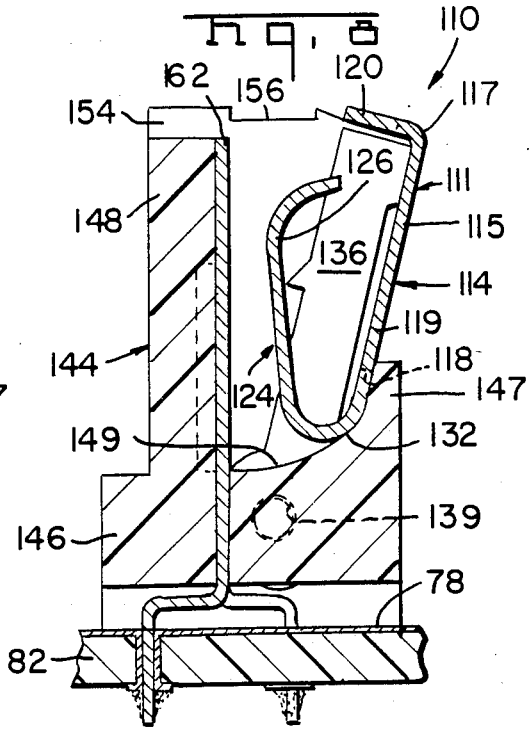
FIG. 8 is a cross-sectional view similar to FIG. 7 but having the assembly in its open position.

FIGS. 6 to 8 illustrate and alternative embodiment 110 of the assembly. The assembly 110 is comprised of a spring member 111 and a housing member 144. The spring member is comprised of a first body section 114 and a second body section 124 and an intermediate bight section 132, which connects the first and second sections 114, 124. The intermediate section 132 is reversely bent through the bight area so that the second portion 124 of the spring member 111 lies behind the first body portion 114. In this embodiment it is preferred that the first portion 114 not be embossed so that the first portion 114 will have some flexibility.

The first section 114 is comprised of a rectangular plate member 115 having first and second side edges 117 and 118 and end edges 119. The first side edge 117 has an outwardly directed flange 120 extending therefrom. Locking extensions 122 extend from the flange 120. In this embodiment, end sections 136 only extend along a portion of the end edge 119 of plate member 115 ending at 135. The remaining portion of 119, remains free. This provides greater flexibility to the first portion 114 and a bending moment at 135. The end sections have a mounting means 139 near the lower edge, said mounting means comprising a hole or bore which cooperates with a protrusion in the housing to provide pivot means for spring member 111 when it is attached to the housing 144.

The one piece housing means 144 is comprised of a base member 146, upstanding support wall 148 and side walls 154. Upstanding conductor members 162 lie along the support wall 148 and are in electrical contact with the conductors 78 on substrate 82. The base wall 146 has a spring retaining wall 147 that extends upwardly essentially parallel to the back support wall 148. The interior surface 149 of the wall 147 is shaped to strengthen the wall 147 as this wall provides the back up for the contact force.

FIG. 8 illustrates the spring member 111 in its open position. The spring arms 126 are juxtaposed to the upstanding conductor members 162 on the support wall 148 of the housing 144.

In using assembly embodiment 110, cable 72 is inserted between the upstanding conductor members 162 and the spring member 111. Again, the space between the upstanding conductor members 162 and the spring arm member 111 is sufficient to permit insertion of the cable under zero insertion force conditions. After the cable is inserted into the assembly 110, pressure is applied to the spring arm member 111 so that the locking extension 122 on the flange 120 engages a locking notch 156 on the sidewall 154 of the housing 114. As this is being accomplished the bight portion moves about the pivot means until a sufficient resistance is met as the spring arms 126 engage the cable 72 whereupon the bight portion then moves in the opposite direction about bending moment 135 until it is stopped by the upstanding retaining wall 147 which provides a continuous back-up support along the entire length of the spring member 111 to insure uniformity of pressure all along the spring member 111.

Spring members 11, 111 in accordance with the invention can be manufactured in strip form with the individual members 11, 111 connected to a carrier strip. The sections can be stamped and formed and removed from the carrier strip by means known in the art. Preferably the member 11, 111 is stamped and formed of a suitable material having good spring characteristics such as a spring steel. It need not have good electrical conductivity for the reason that it serves to press the cable conductors 70 against upstanding conductors 62 and does not carry current. Since the spring member is not electrically involved in the electrical connections, it is not necessary to insulate the device. A thin insulating coating can be used, however, if desired.

It is to be understood that the cable can be of the type having metal conductors, such as flat flexible cable, conductors which have been left on a surface as a result of an etching such as flexible etched cable, and cable in which the conductors have been screened. The zero insertion force characteristics of the device enable all types of cables to be used.

Zero insertion force connector devices in accordance with the invention can be used as a matter of convenience when the film is relatively heavy and the conductors are wrought conductors which will withstand abrasion and compressive force during insertion. The use of the present system will facilitate the insertion operation and permit the technician to concentrate on proper location of the cable in the assembly 10, 110. The use of the present zero insertion force system is, however, highly desirable if not necessary, when the film is relatively thin and flimsy and the conductors 70 on the cable 72 are extremely fragile and subject to damage. It will thus be apparent that a zero insertion force connector device in accordance with the invention can be used under all circumstances where conductors on a film are to be connected to spaced apart conductors on a substrate.

In the drawings and specification, there has been set forth preferred embodiments of the invention, and although specific terms are employed, they are used in a generic and descriptive sense only, and not for purposes of limitation.

What is claimed is:

1. An electrical interconnection assembly for interconnecting conductors in an array to circuitry on the surface of a substrate, the connector comprising:

a housing attachable to the substrate and having a plurality of conductor members each electrically connectable to corresponding circuitry on the substrate;

a unitary spring metal member attachable to the housing and further comprising a formed metal body having a first section and a second section joined by an intermediate bight, the first and second sections being relatively inclined about an acute included angle in a first position, the first and second sections being mutually relatively deflectable about said bight to a second position in which the relative inclination therebetween is less than in the first position, and a lock depending from the first section for retaining the first and second sections in the second position, energy being stored in the body in the second position, whereby upon positioning the array of conductors between the second body section and the conductor members in the housing, and deflecting the first section to the second position, the stored energy is transmitted through the second section to the conductor array to maintain a normal force electrical contact between the conductors in the array and the circuitry on the substrate.

2. The electrical interconnection assembly of claim 1 wherein the housing comprises a base attachable to the substrate and a support wall extending from the base perpendicular to the substrate.

3. The electrical interconnection assembly of claim 2 wherein the conductor members extend through the base and along a surface of the support wall.

4. The electrical interconnection assembly of claim 2 wherein the housing is further comprised of sidewalls which extend from the base to the substrate and are essentially perpendicular to the support wall.

5. The electrical interconnection assembly of claim 4 wherein the spring metal member is attached to the housing sidewalls.

6. The electrical interconnection assembly of claim 5 wherein the spring metal member is pivotally mounted relative to the base.

7. The electrical interconnection assembly of claim 6 wherein the lock is engageable with the sidewall in the second position.

8. The electrical interconnection assembly of claim 7 wherein the lock comprises at least one flange formed from a free edge of the first section and extending laterally relative to the cantilever arms.

9. The electrical interconnection assembly of claim 1 wherein the first and second sections are both deflectable relative to the support wall upon movement from the first to the second position.

10. The electrical interconnection assembly of claim 9 wherein the second section exerts greater normal force relative to the support wall in the second position than in the first position.

11. The electrical interconnection assembly of claim 10 wherein the second section exerts zero normal force relative to the support wall in the first position.

12. The electrical interconnection assembly of claim 1 wherein the second body section comprises a plurality spaced cantilever arms extending from the bight.

13. The electrical interconnection device of claim 1 wherein the lock comprises a flange formed from a free edge of the first section.

14. The electrical interconnection assembly of claim 13 wherein the flange extends laterally beyond the first section.

15. The electrical interconnection assembly of claim 14 wherein the second section comprises a plurality of laterally spaced cantilever arms, the flange extending laterally relative to the cantilever arms.

16. The electrical interconnection assembly of claim 4 wherein said base further has a spring member retaining wall extending from said base, essentially parallel to and spaced apart from said support wall, said retaining wall extending between said sidewalls and providing means to retain and support said bight section of said spring member.

17. A zero insertion force electrical interconnection assembly for interconnecting conductors in a flat cable to circuitry on the surface of a rigid substrate, the assembly comprising:

a housing electrically connectable to the substrate and having a plurality of conductor members each attachable to corresponding circuitry on the substrate;

a unitary spring metal member attachable to the housing and further comprising a formed metal body having a first section and a second section joined by an intermediate bight, the first and second sections being relatively inclined about an acute included angle in a first position, the first and second sections being mutually relatively deflectable about said bight to a second position in which the relative inclination therebetween is less than in the first position, and a lock depending from the first section for retaining the first and second sections in the second position, energy being stored in the body in the second position, whereby upon positioning the array of conductors between the second body section and the conductor members in the housing, and deflecting the first section to the second position, the stored energy is transmitted through the second section to the conductor array to maintain a normal force electrical contact between the conductors in the array and the circuitry on the substrate.

18. The zero insertion force electrical interconnection assembly of claim 17 wherein the housing comprises a base attachable to the substrate and a support wall extending from the base perpendicular to the substrate.

19. The zero insertion force electrical interconnection assembly of claim 18 wherein the conductor members extend through the base and along a surface of the support wall.

20. The zero insertion force electrical interconnection assembly of claim 18 wherein the housing is further comprised of sidewalls which extend from the base to the substrate and are essentially perpendicular to the support wall.

21. The zero insertion force electrical interconnection assembly of claim 20 wherein the spring metal member is attached to the housing sidewalls.

22. The zero insertion force electrical interconnection assembly of claim 21 wherein the spring metal member is pivotally mounted relative to the base.

23. The zero insertion force electrical interconnection assembly of claim 22 wherein the lock is engageable with the sidewall in the second position.

24. The zero insertion force electrical interconnection assembly of claim 23 wherein the lock comprises at least one flange formed from a free edge of the first section and extending laterally relative to the cantilever arms.

25. The zero insertion force electrical interconnection assembly of claim 17 wherein the first and second sections are both deflectable relative to the support wall upon movement from the first to the second position.

26. The zero insertion force electrical interconnection assembly of claim 25 wherein the second section exerts greater normal force relative to the support wall in the second position than in the first position.

27. The zero insertion force electrical interconnection assembly of claim 17 wherein said base further has a spring member retaining wall extending from said base, essentially parallel to and spaced apart from said support wall, said retaining wall extending between said sidewalls and providing means to retain and support said bight section of said spring member.

* * * * *